United States Patent [19]

Rathmell

[11] 4,326,343

[45] Apr. 27, 1982

[54] APPARATUS AND METHOD FOR RECOVERING VOLATILE COMPOUNDS

[76] Inventor: Richard K. Rathmell, 12 Pine Tree Rd., Ramsey, NJ 07446

[21] Appl. No.: 158,079

[22] Filed: Jun. 10, 1980

[51] Int. Cl.[3] ..... F26B 21/10

[52] U.S. Cl. ..... 34/51; 34/77; 34/155; 118/61; 137/207

[58] Field of Search ..... 118/61; 34/77, 78, 51, 34/15, 27, 32, 155; 137/207, 209

[56] References Cited

U.S. PATENT DOCUMENTS 4,012,847 3/1977 Rand ..... 34/77

4,197,657 4/1980 Leino et al. ..... 34/51

*Primary Examiner*—Larry I. Schwartz

[57] ABSTRACT

It has been known that volatile organic compounds evaporated in a substantially closed drying oven may be recovered by condensing part of the vapors in a cooler and recycling the mixture of the non-condensed vapor and inert gas back to the oven. However, non-steady state conditions tend to cause volume and pressure variations resulting in an out-breathing of oven atmosphere through the oven's entrance and exit ports, and an in-breathing of outside atmosphere. The invention provides a flexible expansion-contraction chamber to temporarily receive excess gas volume return it to the oven with minimal change in pressure. This reduces the loss of vapor, minimizes the need for inert gas addition, and conserves energy.

3 Claims, 1 Drawing Figure

APPARATUS AND METHOD FOR RECOVERING VOLATILE COMPOUNDS

BACKGROUND

Figure 1:
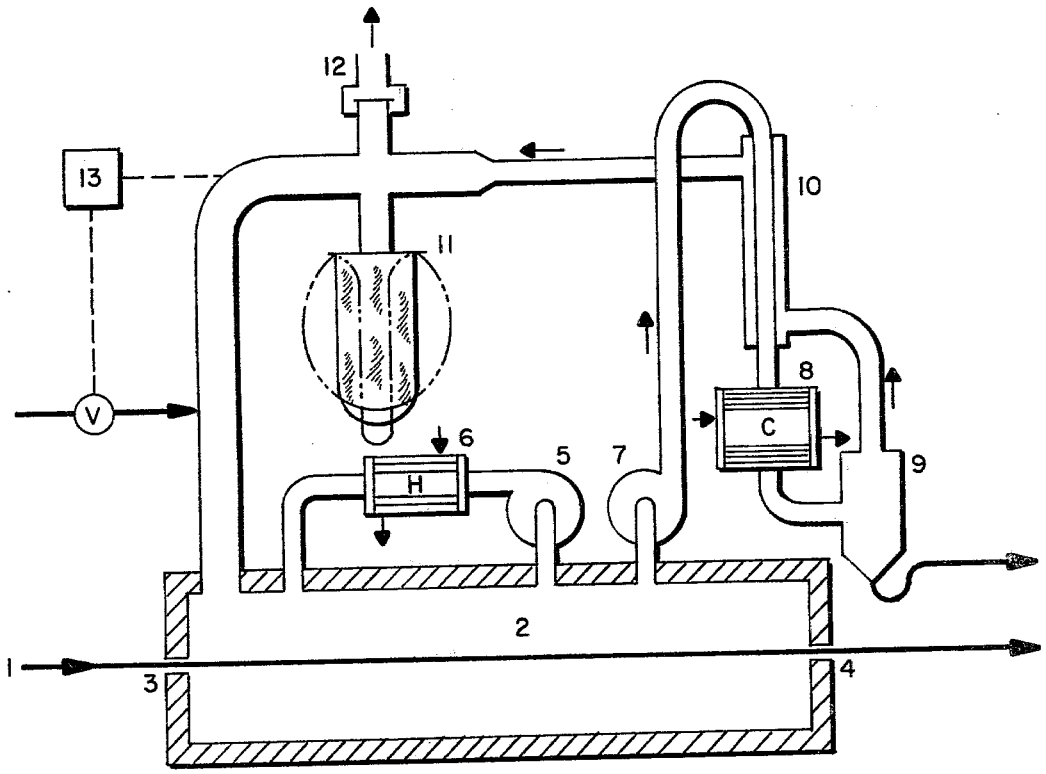

Many coating formulations, such as paints, varnishes, lacquers and inks, contain volatile organic compounds which are evaporated to dry or cure the coating. The general practice has been to allow the volatile compound to pass into the atmosphere. In many industrial coating applications, heated air is used to speed up the curing or drying time.

There are new incentives to change present practices. The emissions of volatile organic compounds (VOC) are being regulated to improve the ambient air quality in the United States. The recent price increases for petroleum and its derivatives has greatly increased both the cost of VOC's and the cost of energy to heat the air to speed the drying or curing.

In setting up the guidelines for regulation of VOC emissions, the U.S. Environmental Protection Agency (EPA) has research into "Reasonalbly Available Control Technology" (RACT). (See EPA-450/2-77-008-OAQPS, No. 1.2-073.) Three approaches were judged to be available. These are:

1. Reformulation, either to substitute water for VOC or to use high-solid, low-solvent formulations.
2. Recovery, where activated carbon is used to adsorb VOC and steam is used to expel the VOC from the carbon so the carbon can be reused.
3. Incineration, where the VOC vapors are burned at high temperatures to carbon dioxide.

Those who are "familiar with the art" know that tradeoffs are involved, or there are penalties associated with each of the above approaches. The reformulated coatings may be more difficult to apply, or have poorer use characteristics, or be slower drying when formulated with water instead of a more volatile organic compound. Recovery using carbon is relatively expensive; the carbon may be fouled with high boiling compounds, ineffective for alcohols, and subject to spontaneous ignition. The cost to recover a wet mixture of solvents in many cases will exceed the cost of purchasing new solvents. Incineration is also relatively expensive, but more able to accommodate any mixture of solvents (or VOC) without disrupting present quality. Additional fuel (or energy) is generally needed to heat the VOC air mixture to a combustion temperature.

This invention is to make the recovery of VOC more economical and to conserve energy in those operations where a drying oven or a curing oven is used. It is applicable where sheet metal, paper, film, or textile materials (any web) is coated or printed and passed into an oven to speed up the removal of any volatile organic compounds. It is also applicable where webs or various parts, shapes, or objects are moved through an oven to facilitate either a drying or curing reaction with the incidental release of organic vapors. For instance, formulated compositions such as brake shoes and clutch plates may be dried to remove alcohol or simultaneously cured with the progression of a chemical reaction. Some curing operations, such as setting of a foamed plastic coating can lead to the incidental vapor emission of a relatively high-boiling plasticizer.

It is well known that explosion prevention is very important in the operation of any drying or curing oven. Most commonly, excess air is blown through an oven to prevent the organic vapor level from approaching too closely to the lower explosive limit (LEL).

This invention is directed to VOC recovery by vapor condensation, wherein gases from the relatively warm oven are passed through a condenser and returned to the oven. This approach is not new, but it has not been commonly practiced or considered. U.S. Pat. No. 1,075,586, issued in 1913, describes the recirculation of a dryer gas through condenser and back to the dryer. In 1923, Smith was granted U.S. Pat. No. 1,470,650 for a similar arrangement where the recirculation rate was controlled to prevent the build-up of explosive compositions. Subsequently, it has become common knowledge that an inert gas such as nitrogen, instead of air, can be supplied to maintain non-explosive compositions in a dryer or oven. Relatively recently, in 1979, Rothchild was granted U.S. Pat. No. 4,150,494 for a system wherein a mixture of vapor and inert gas contained in the oven is withdrawn through a relatively cold condenser (to condense at least 85% of the vapor) and a major portion of the non-condensed gas and vapor is discharged to the atmosphere. The inert gas supplied to this system is shown to flood the outside of both the entrance and exit ports of the oven so that inert gas rather than air is drawn into the oven. Cryogenic or refrigerated condenser temperatures, such as those achieved with liquid nitrogen are indicated to be preferred.

It is obvious that the efficiency of a vapor condensation process is increased if the concentration of vapor in the oven atmosphere is increased, but on the other hand, the drying rate may be decreased or stopped if the vapor concentration is too high. In most cases, a small increase in oven temperature can be made to increase the drying rate. In all cases, drying will occur when the oven temperature is above the boiling point of the VOC. Trials to demonstrate Rothchild's process have proven that satisfactory drying rates can be maintained even with relatively high VOC vapor concentrations in the oven. In those cases where a residual solvent odor is unacceptable, a second stage or final drying with excess air may be needed, but the relatively small amount of VOC removed at this stage generally is not worth the cost that would be required for its recovery.

If a drying oven could be hermetically sealed, all VOC liquid in the warm oven chamber could be vaporized and transported to a relatively cool condenser. However, all ovens designed for continuous operation necessarily have an entrance port and an exit port. When the temperture inside an oven increases and/or when the average composition changes to include more VOC vapor relative to non-condensable gases, the normal effect is an increased internal pressure with a resultant flow of gas and VOC vapor out through the port openings. Conversely, when the temperature in an oven decreases and/or the average composition changes to less vapor, the normal effect is for a decreased internal pressure and a flow of external atmosphere through the port openings.

Even with a well operated continuous oven, it is not practical to always maintain constant temperatures and vapor compositions in the closed system; therefore, there is a tendency for alternate inhalation of external atmosphere and exhalation of oven atmosphere which includes VOC vapor.

OBJECT OF THIS INVENTION

It is the object of this invention to simplify and to minimize the cost of VOC recovery by vapor condensation.

It is a further object to reduce the amount of inert gas required to maintain a reliable non-explosive composition in the oven or any part of the system.

It is a further object to eliminate the need for relatively cold condensers which operate below the freezing point of water and are subject to frost or ice blockage.

DESCRIPTION OF THE INVENTION

With reference to FIG. 1, the new element to the drying oven system is a relatively flexible expansion-contraction chamber, (11) provided to minimize the inhalation of external atmosphere into the oven and the exhalation of VOC vapor from the oven. FIG. 1 depicts a wet coated web (1), or material to be cured, moving into a drying or curing oven (2) through entrance port (3) and moving out through exit port (4).

Atmosphere from the oven may be circulated by fan (5) through a heater (6) and returned to the oven, or alternately, heating surfaces may be located within the oven for convective and radiant heat transfer to the material to be dried or cured. Atmosphere from the oven is also circulated by fan (7) to a cooler (8) and a condensate receiver (9). A counter current gas/gas heat exchanger (10) may be provided for economy of operation, and the oven and hot ducts may be insulated to minimize heat losses. The relatively flexible expansion-contraction chamber (11) is constructed so that it may expand with relatively little increase in internal pressure or contract when there is a relatively small decrease in pressure. Preferably it should be part full when the atmosphere in the oven is at the same pressure as the outside atmosphere. It may be an add-on chamber connected by a duct to the oven chamber as illustrated in FIG. 1, or the oven chamber itself may be constructed to perform as the expansion-contraction chamber. The expansion-contraction chamber preferably is constructed with a relatively flexible and impervious coated fabric or film, which is in contrast to the common practice of using sheet metal to enclose an oven space. The flexible expansion-contraction chamber is able to be inflated with relatively little increase in pressure, and able to be deflated with relatively little decrease in pressure. In a preferred arrangement, the expansion-contraction chamber will be part full when the oven is at atmospheric pressure. The dotted lines illustrate both the inflated and deflated cross section of the chamber (11). Excess pressure or gas volume within the oven may be vented through the pressure relief port (12). Inert gas admission to the oven may be controlled (13) to maintain a non-explosive composition.

In operation, the flexible expansion-contraction chamber operates like a lung which automatically inhales excess oven gas volumes with a relatively small increase in pressure, and automatically exhales gas volume to the oven as needed to maintain substantially constant atmospheric pressure in the oven. Because the oven pressure is thereby maintained at substantially constant atmospheric pressure, the normal variations in pressure differential at the entrance and exit ports are substantially eliminated along with the tendency for the oven to inhale outside atmosphere and exhale oven atmosphere to the outside atmosphere.

EXAMPLE

In a continuous coating operation the rate of application required the evaporation of an average of 360 lb solvent/hr (about 24 scfm) or a maximum of 450 lbs/hr (about 30 scfm). The two-stage oven space of about 1,000 $ft^3$ was ventilated with 20,000 scfm of air discharged at 225° F. to the atmosphere.

The energy requirements for heat were approximately:

| | |
|---|---|
| 1. to heat the air flow | 4,088,000 BTU/hr |
| 2. to heat the web and coating | 100,000 BTU/hr |
| 3. to evaporate solvent | 50,000 BTU/hr |
| 4. oven surface losses | 10,000 BTU/hr |
| TOTAL | 4,248,000 BTU/hr |

After modification of this same operation to provide a flexible expansion-contraction chamber and a closed loop recycle system in accordance with the subject invention, a water cooled condenser cools the gas-vapor mixture to a 38 mm partial pressure of VOC (5% by volume at about 87° F.). A fan circulates 200 scfm of oven atmosphere to the condenser. The condenser removes an average of approximately 22 scfm of vapor, leaving 178 scfm for recycle to the oven. The counter current heat exchanger (8) reheats the recycle stream to 180° F. and the heater (5) maintains an oven temperature of 230° F. The equilibrium oven atmosphere is about 15.5% VOC by volume.

The energy requirements for heat are approximately:

| | |
|---|---|
| 1. to heat the inert gas recycle | 10,000 BTU/hr |
| 2. to heat the web and coating | 100,000 BTU/hr |
| 3. to evaporate solvent | 50,000 BTU/hr |
| 4. surface losses | 10,000 BTU/hr |
| | 170,000 BTU/hr |

In order to strip residual VOC odor from the product, the second stage of the oven is operated with recirculated hot air. Air discharge and air make-up is controlled by a LEL controller set for 15% LEL. Approximately 5% of the VOC is removed with this air flow and the average flow is 800 scfm. The energy requirement to heat this air flow is approximately:

| | |
|---|---|
| 5. to heat stripping air | 170,000 BTU/hr |
| TOTAL | 340,000 BTU/hr |

The energy savings are approximately 92% and the solvent recovery efficiency is as good, with approximately 325 lb/hr of useful dry solvent recovered.

The pressure within the oven on the average is equal to atmospheric pressure, but non-steady state conditions tend to expand or contract the total volume of vapor and inert gas contained in system. The expansion-contraction chamber was designed to accommodate the majority of volume fluctuations with a minimum of pressure change. The flexible chamber is an elongated hanging bag with a spread top, constructed with a coated fabric weighing 2 oz./$ft^2$. When open to the atmosphere the bag volume is 150 $ft^3$. It requires much less than 1/40 inch of water pressure change to inflate it to 250 $ft^3$, or to deflate it to 50 $ft^3$.

In operation, the chamber volume varies within the range of 125 and 175ft$^3$ approximately one-third of the time. The chamber volume is between 175 and 225 ft$^3$ about one-third of the time, and the very slight increase in the system pressure during this time tends to expel gas and vapor through the oven entrance and exit ports. These ports have an open area less than 0.1 ft$^2$ and the escape velocity is less than 450 ft/minute. Thus, the loss of oven atmosphere is less than 15 ft$^3$/minute, on the average. With a VOC composition of 5% flooding the inside of both the entrance and exit ports, the corresponding VOC vapor loss is less than 3.1% of the VOC handled. If the condenser were cooled with chilled water, the corresponding VOC loss could be less than 1%.

The foregoing example is intended to illustrate the invention but not limit it to the cited numbers. It is obvious that smaller size flexible chambers may be adequate where steadier state conditions can be maintained, and larger chambers will be needed in other cases. Lower condenser temperatures may be appropriate for some relative low boiling compounds, and air cooled condensers may be preferred for intermediate and relatively high boiling compounds. The flexible chamber may be integrated into the system as shown so that it normally receives relatively "dry" gas or it may be connected elsewhere to the oven. The flexible chamber preferably is constructed of a relatively lightweight coated material which is resistant to both VOC vapor and the condensed VOC.

What is claimed is:

1. Apparatus for recovering volatile compounds which are evaporated within an oven, said oven having relatively small openings to the outside atmosphere and having means to circulate the contained oven atmosphere of vapor and non-condensable gas to a cooler where part of the vapor may be condensed, and means to return the non-condensed portion of the oven atmosphere to the oven, the improvement comprising a relatively flexible expansion-contraction chamber having means to receive and become inflated with excess oven atmosphere and with relatively little increase in pressure when the rate of evaporation temporarily exceeds the rate of vapor condensation, and conversely, having means to be deflated with relatively little decrease in pressure and to return the contained atmosphere when the rate of vapor condensation temporarily exceeds the rate of evaporation.

2. Apparatus as in claim 1, wherein the expansion-contraction chamber is connected by a conduit to alternately receive and return non-condensed gases such as are recirculated to the oven chamber from the condenser.

3. Apparatus as in claim 1, wherein the expansion-contraction chamber is part full when the pressure of the atmosphere within the oven is equal to the pressure of the atmosphere outside the oven.

* * * * *